US011056330B2

(12) United States Patent
Silivra et al.

(10) Patent No.: US 11,056,330 B2
(45) Date of Patent: Jul. 6, 2021

(54) APPARATUS AND SYSTEM FOR ACTIVE HEAT TRANSFER MANAGEMENT IN ESI ION SOURCES

(71) Applicant: Thermo Finnigan LLC, San Jose, CA (US)

(72) Inventors: Oleg Silivra, Milpitas, CA (US); Mark E. Hardman, Santa Clara, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/230,714

(22) Filed: Dec. 21, 2018

(65) Prior Publication Data

US 2020/0203141 A1 Jun. 25, 2020

(51) Int. Cl.

| | |
|---|---|
| ***H01J 49/16*** | (2006.01) |
| ***H01J 49/04*** | (2006.01) |
| ***H01J 49/26*** | (2006.01) |

(52) U.S. Cl.

CPC ..... *H01J 49/167* (2013.01); *H01J 49/0486* (2013.01); *H01J 49/26* (2013.01)

(58) Field of Classification Search

None

See application file for complete search history.

(56) References Cited

U.S. PATENT DOCUMENTS 2,702,334 A * 2/1955 Kleist ..... F24H 3/002 392/343
4,853,539 A 8/1989 Hall et al.
6,196,298 B1 * 3/2001 Shaw ..... F21V 29/004 165/80.3
6,759,650 B2 * 7/2004 Covey ..... H01J 49/049 250/282
7,960,711 B1 * 6/2011 Sheehan ..... H01J 49/045 250/281
8,039,795 B2 10/2011 Mordehai et al.
8,759,757 B2 6/2014 Hardman et al.

(Continued)

FOREIGN PATENT DOCUMENTS

| | | |
|---|---|---|
| EP | 2688087 A2 | 1/2014 |
| EP | 3671811 A1 | 6/2020 |
| GB | 2520153 B | 10/2016 |

OTHER PUBLICATIONS

Cha et al., "Coupling of gas chromatography and electrospray ionization high resolution mass spectrometry for the analysis of anabolic steroids as trimethylsilyl derivatives in human urine", Analytica Chimica Acta 964 (2017), pp. 123-133.

(Continued)

*Primary Examiner* — James Choi
(74) *Attorney, Agent, or Firm* — Thomas F. Cooney

(57) ABSTRACT

An electrospray ion source comprises: a needle capillary comprising a spray tip end and an opposite end; a nebulizing gas channel parallel to the needle capillary; an auxiliary gas channel parallel to the needle capillary; a heater parallel to a length of the auxiliary gas channel; a thermally conductive heat transfer member parallel to a length of the needle capillary and disposed between the needle capillary and the heater, said heat transfer member having a first end adjacent to the spray tip end of the needle capillary and a second end opposite to the first end; and a cooled heat sink member in thermal contact with the second end of the heat transfer member.

14 Claims, 9 Drawing Sheets

(56) References Cited

U.S. PATENT DOCUMENTS

| | | | | |
|---|---|---|---|---|
| 8,766,179 | B2 | 7/2014 | Kaltashov et al. | |
| 8,772,709 | B2 | 7/2014 | Moeller et al. | |
| 9,123,521 | B2 | 9/2015 | Verenchikov | |
| 2003/0189170 | A1* | 10/2003 | Covey | H01J 49/049 250/288 |
| 2007/0071646 | A1* | 3/2007 | Schoen | H01J 49/02 422/68.1 |
| 2009/0250608 | A1* | 10/2009 | Mordehai | H01J 49/167 250/288 |
| 2012/0104248 | A1* | 5/2012 | Hardman | H01J 49/165 250/288 |

OTHER PUBLICATIONS

Wang et al.,"Direct Monitoring of Heat-Stressed Biopolymers withTemperature-Controlled Electrospray Ionization Mass Spectrometry", Anal. Chem. 2011, 83, pp. 2870-2876.

Yong et al., "Thermal effects on electrospray ionization ion mobilityspectrometry", International Journal of Mass Spectrometry and Ion Processes 154 (1996), pp. 1-13.

EPO, "Communication regarding the transmission of the European Search Report (1507)", EP Appl. No. 19217175.9, dated May 4, 2020.

* cited by examiner

APPARATUS AND SYSTEM FOR ACTIVE HEAT TRANSFER MANAGEMENT IN ESI ION SOURCES

TECHNICAL FIELD

The present disclosure relates to mass spectrometers and mass spectrometry. In particular, the present disclosure relates to ion sources for mass spectrometry.

BACKGROUND

Mass spectrometry is a well-established method of analyzing for the presence and concentration (or amount) of a wide variety of chemical constituents with high sensitivity. Since mass spectrometric analysis includes detection or quantification of various ions having varying mass-to-charge ratios, it is necessary to ionize the molecules of chemical constituents that are dissolved in a liquid stream. Heated electrospray ionization (HESI) is a common atmospheric-pressure ionization technique that may be employed to ionize chemical constituents of samples provided in liquid form. The HESI source sprays a nebulized liquid spray where the tip of the sprayer (e.g., a nozzle such as of a capillary tube) has or provides an electrical potential that transfers charge to the droplets. These droplets are then dried by a heated flow of auxiliary gas before being introduced into the vacuum chambers of a mass spectrometer. The evaporation of solvent by the heated auxiliary gas liberates ions, including protonated "molecular" ions generated from the dissolved molecules. The liberated ions are then drawn into an aperture that leads to an evacuated chamber by an applied electric field. At the same time, neutral gas molecules and residual droplets are directed along a physical flow path that does not intersect the aperture.

A common problem of ion sources that employ heated auxiliary gas is that they must be optimized to handle two conflicting requirements. The need for higher ion signal demands increasing auxiliary gas temperature, with a higher gas temperature providing better desolvation and, hence, higher detected signal. On the other hand, the heating of the auxiliary gas results in heat transmission to other components, including the needle capillary delivering the sample. Such heat transfer is undesirable, because heating of the solvent flowing in the capillary may lead to issues with cavitation and boiling.

Experimental results indicate that there is an increase in the relative standard deviation (RSD) of the ion signal intensity, as measured by a mass spectrometer, as the temperature of a heater in the vicinity of a HESI needle capillary is increased above a certain threshold value. For example, FIG. 1 is a set of graphs of the variation of RSD of mass spectrometer measurements of four different ions plotted against auxiliary gas temperature of a heated electrospray ion source of the mass spectrometer. Specifically, a four-compound mixture in a mobile phase solvent was injected five times at each controlled gas temperature into a chromatograph interfaced to the ion source. The mass spectrometer measurement of a signal intensity of a distinctive ion of each respective compound was obtained as each compound eluted during a gradient elution at a controlled flow rate of 300 μL per minute. The RSD values plotted in FIG. 1 indicate that, under these particular experimental conditions, the measurement reproducibility of each ion species abruptly deteriorates at a measured gas temperature in the range of 550-575° C. and then returns to lower values at still higher temperatures, with a corresponding reduction in overall signal intensity. Without being bound to a particular explanation of this behavior, the inventor hypothesizes that overheating of the needle capillary near to and above the boiling point of the solvent causes boiling and/or cavitation at the spray tip of the electrospray needle that generates intermittent spattering of droplets from the spray tip. The inventor further hypothesizes that at still higher heater temperatures, such boiling/cavitation occurs within the needle at distances within the needle removed from the spray tip, such that only vapor is emitted from the actual tip. This exact value at which disruption of the electrospray process occurs may depend on such factors as solvent composition, flow rate, auxiliary gas flow rate, etc.

To date, approaches to reduce heat transfer to the capillary have involved passive approaches such as the use of insulation or heat reflectors, including the use of a vacuum chamber surrounding the needle capillary. Performance of a HESI ion source could potentially be improved by further reducing the heat that reaches the capillary, thereby allowing still more heat to be applied to the auxiliary gas.

SUMMARY

As a step toward an improved resolution to the above-noted problem of over-heating of a needle capillary of an ion source, the present disclosure provides apparatuses and methods for active heat management. The method is based on implementation of a heat transfer member in the body of an internal probe portion of the ion source and a heat sink in a non-heated portion of the ion source. In one embodiment, the heat transfer member has a shape of a hollow cylinder installed concentrically around the needle capillary. One end of the heat sink is located close to the spraying tip (i.e., the "hot" end) of a needle capillary which carries a flow of a liquid sample that is to be ionized. The other end (i.e., the "cold" end) of the heat transfer member extends into a region not heated directly by the auxiliary gas heater. The cold end is thermally connected to the heat sink member which may be located either inside or outside the probe section and, possibly, completely external to the probe section. The heat sink member may comprise an active cooler such as a radiator and a fan, a Peltier cooler device, a block having an internally flowing cooling liquid, etc. Combined with temperature measuring probes, a feedback loop, and control circuitry, the described system may be instrumental for active temperature management in ion source probes.

According to a first aspect of the present teachings, an electrospray ion source comprises: a needle capillary comprising a spray tip end and an opposite end; a nebulizing gas channel parallel to the needle capillary; an auxiliary gas channel parallel to the needle capillary; a heater parallel to a length of the auxiliary gas channel; a thermally conductive heat transfer member parallel to a length of the needle capillary and disposed between the needle capillary and the heater, said heat transfer member having a first end adjacent to the spray tip end of the needle capillary and a second end opposite to the first end; and a cooled heat sink member in thermal contact with the second end of the heat transfer member. In various embodiments, the opposite end of the needle capillary is disposed at a higher elevation than the elevation of the spray tip end. In such instances, the thermally conductive heat transfer member may comprise an internal chamber and a liquid within the internal chamber. The liquid within the internal chamber may comprise a Lipowitz's alloy. In some embodiments, the cooled heat sink member comprises a bladed heat radiator. In some embodiments, the cooled heat sink member comprises an internal channel configured to receive a flow of cooling liquid therein. In some embodiments, the cooled heat sink member comprises a thermoelectric cooler.

According to another aspect of the present teachings, a system comprises: (a) an electrospray ion source comprising: a needle capillary comprising a spray tip end and an opposite end; a nebulizing gas channel parallel to the needle capillary; an auxiliary gas channel parallel to the needle capillary; a heater parallel to a length of the auxiliary gas channel; a thermally conductive heat transfer member parallel to a length of the needle capillary and disposed between the needle capillary and the heater, said heat transfer member having a first end adjacent to the spray tip end of the needle capillary and a second end opposite to the first end; and a cooled heat sink member in thermal contact with the second end of the heat transfer member; (b) a temperature sensor adjacent to the needle capillary; and (c) a temperature controller electrically coupled to the temperature sensor and to the heater.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1:
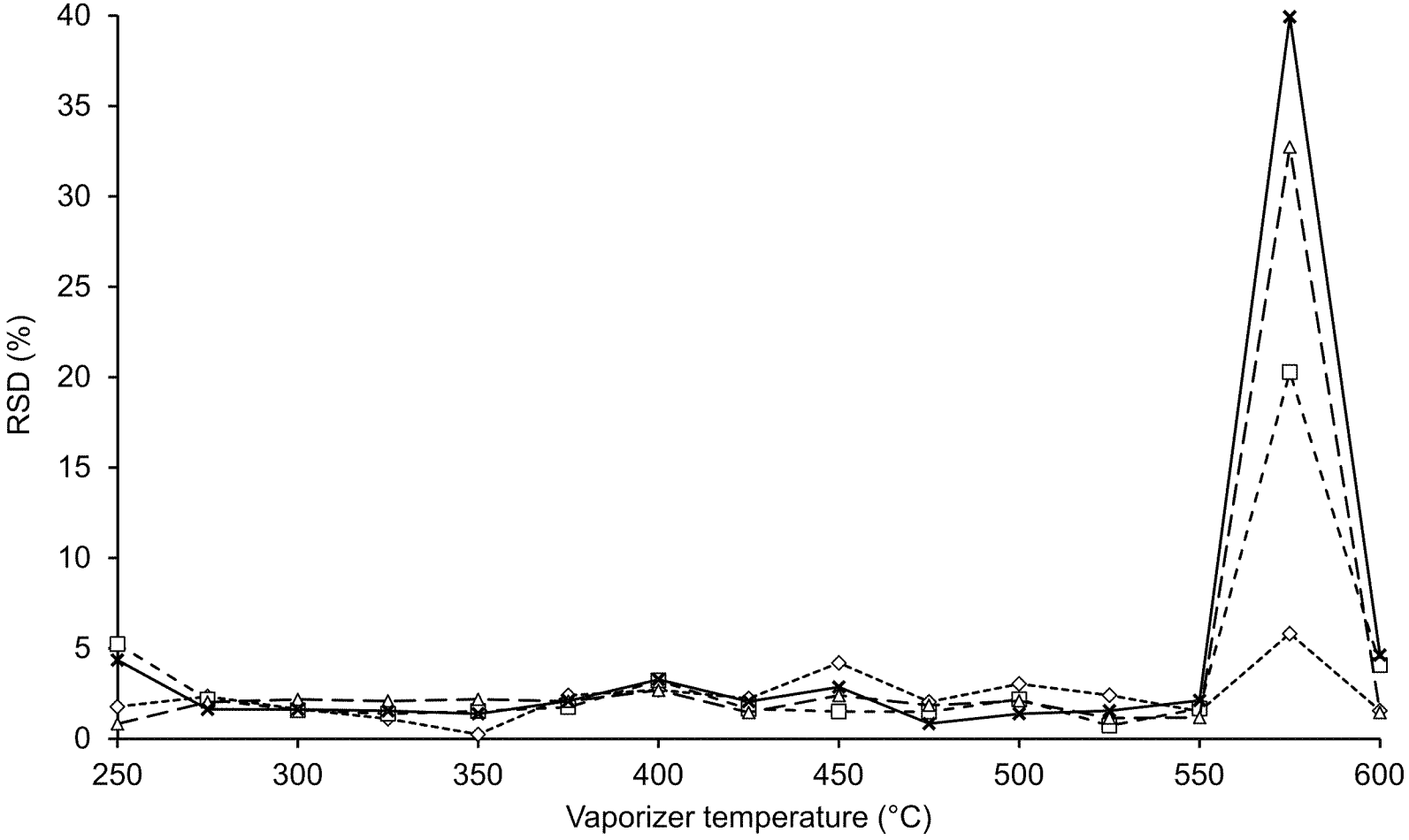
FIG. 1 is a set of graphs of the variation of Relative Standard Deviation (RSD) of mass spectrometer measurements of four different ions plotted against auxiliary gas temperature of a heated electrospray ion source.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1, 2A-2D, 3, 4, 5A-5B and 6.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

As used in this document, the term "probe" refers to an elongated portion of an electrospray apparatus, possibly comprising a plurality of components, that penetrates into an ionization chamber and within which is disposed a length of a needle capillary that comprises a spray tip that emits a spray of charged droplets into the ionization chamber. Unless otherwise defined, all other technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. As used herein, "a" or "an" also may refer to "at least one" or "one or more." Also, the use of "or" is inclusive, such that the phrase "A or B" is true when "A" is true, "B" is true, or both "A" and "B" are true.

Figure 2A:
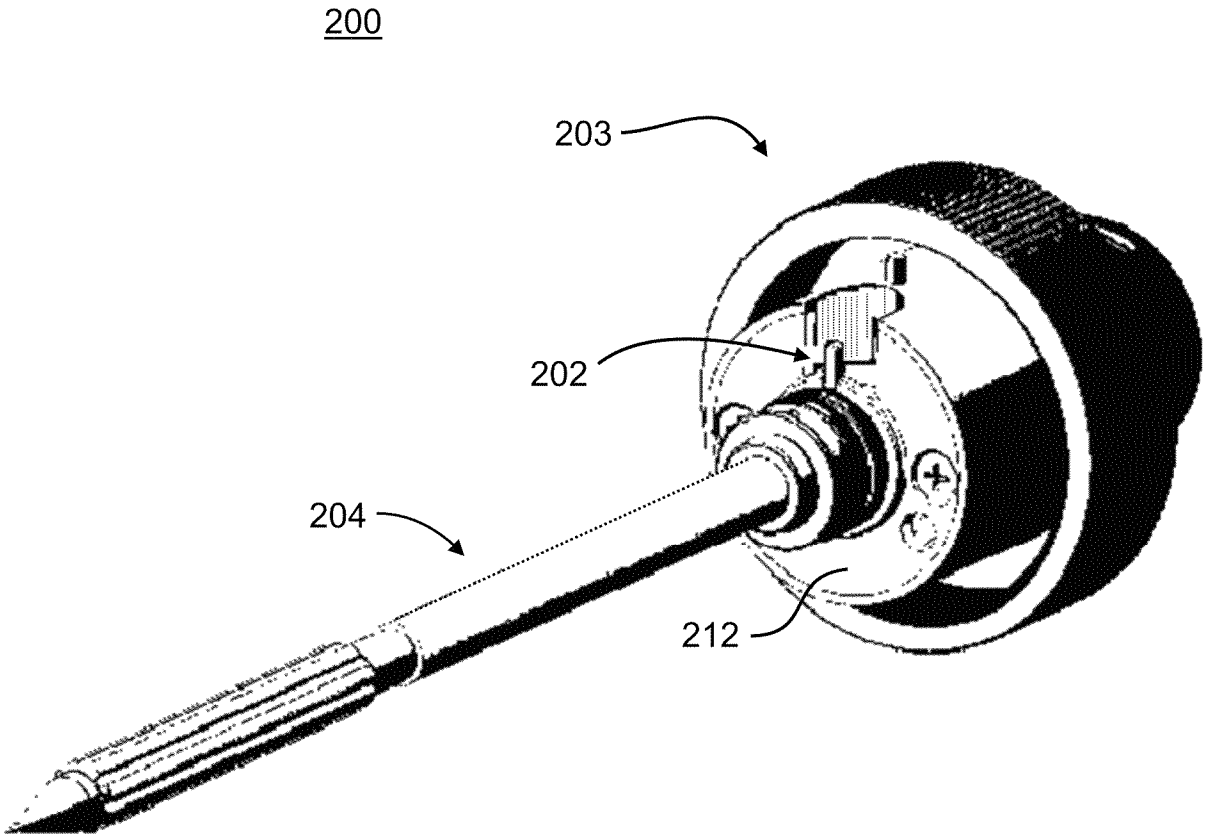
FIG. 2A (Prior Art)
FIG. 2A is a schematic perspective diagram of a probe assembly portion of a known heated electrospray ionization (HESI) ion source for a mass spectrometer.

FIG. 2A is a perspective view of a known HESI probe assembly 200. The probe assembly 200 is designed to mate to a housing, discussed in greater detail below, and to be easily installable on and removable from a mass spectrometer. The assembly comprises a mounting head 203 that physically mates with the housing and a probe 204 that, in operation, projects into an interior 262 of an ionization chamber 261 (see FIG. 2B). The housing provides a heater and also provides all necessary electrical and gas connections required by the probe assembly. The HESI probe assembly 200 comprises a single electrical contact 202 that mates with an electrical contact of the housing. The electrical contact 202 of the HESI probe assembly 200 is in electrical communication with an electrode of the probe 204 and, thus, in operation, may provide a high voltage to the electrode of the probe 204.

Figure 2B:
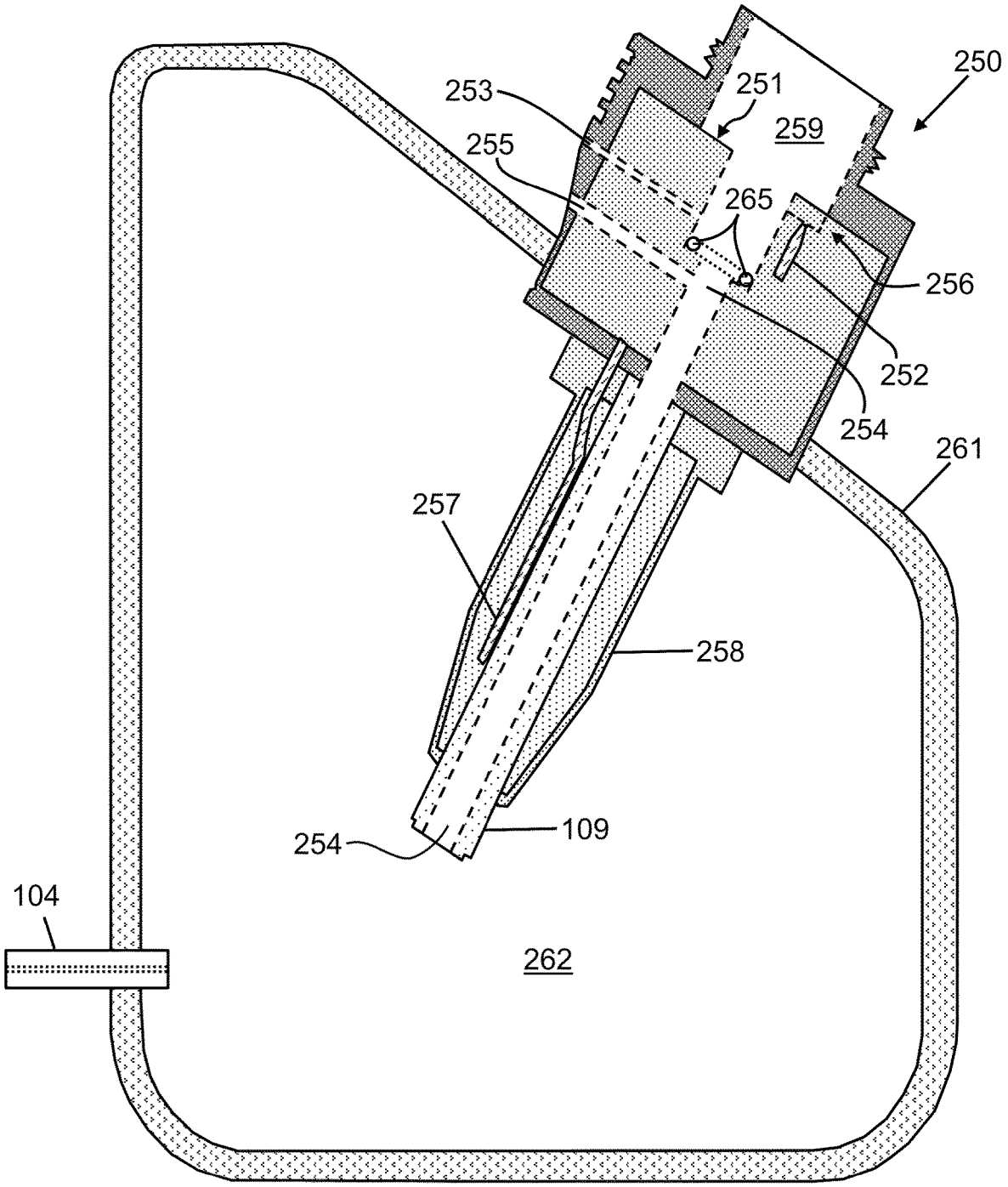
FIG. 2B (Prior Art)
FIG. 2B is a schematic cross-section diagram of a housing assembly of the known HESI ion source referenced by FIG. 2A, illustrated as mounted to an ionization chamber.
Figure 2C:
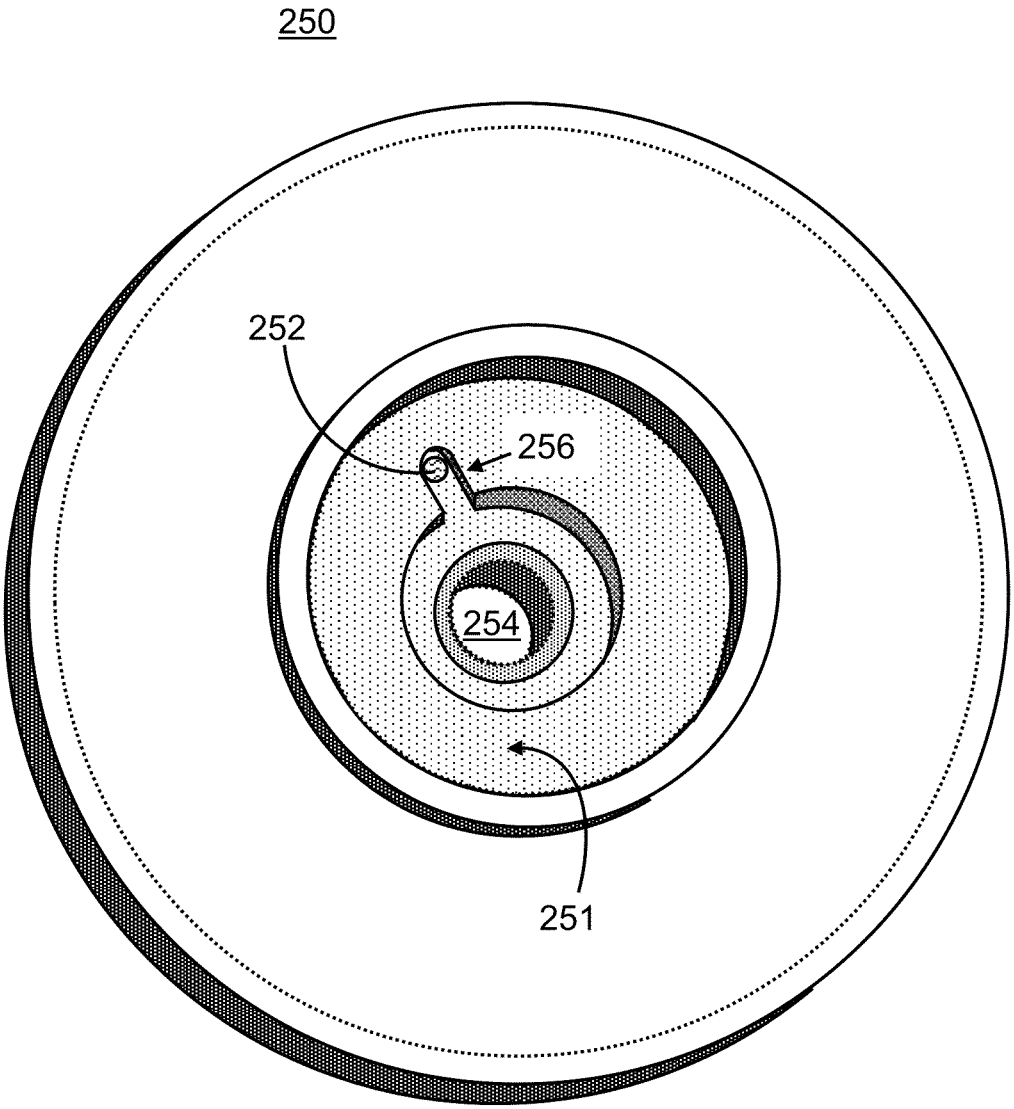
FIG. 2C (Prior Art)
FIG. 2C is a perspective view of a receptacle portion of the HESI ion source housing of FIG. 2B.

FIG. 2B includes a cross sectional longitudinal view of a housing for the HESI probe assembly of FIG. 2A. FIG. 2C is a perspective view of a receptacle portion of the housing 250. In operation, a portion of the mounting head 203 of the probe assembly 200 engages with the walls of receptacle cavity 259 of the housing 250. The housing 250 further comprises a flat surface portion 251 of the receptacle cavity 259 which, in operation, comes into sealing contact (perhaps by means of an intermediate gasket or O-ring) against a mating flat plate portion 212 (FIG. 2A) of the HESI probe assembly 200. A channel 254 within the housing admits and provides a passageway for the probe 204 when the probe assembly is in operational position. At least one recessed area surrounding the channel 254 comprises a slot or groove 256 within which is disposed an electrical contact 252. The first electrical contact 252 is in electrical communication with an electrical power supply apparatus and thus is maintained at a live high voltage. Upon installation of the probe assembly 200 into its operating position, the electrical contact 252 comes into contact with the mating electrical contact 202 of the HESI probe assembly 200, thereby electrically energizing an electrode of the probe assembly.

FIG. 2B is a schematic cross-sectional view of housing 250, as mounted onto an ionization chamber 261. A first gas inlet port 253 provides a nebulizing gas which, in operation, is introduced into a mating inlet hole in the HESI probe assembly 200. The nebulizing gas is carried through a dedicated channel 118 of the probe 204 (see FIG. 2D) to the end of the needle capillary where it assists in producing a spray plume that comprises a multitude of charged droplets of a sample. A second gas inlet port 255 is used to introduce an auxiliary gas which assists in desolvation of the sample droplets. The auxiliary gas is prevented from escaping the housing to atmosphere by O-ring 265. The housing 250 further includes a heater 109 and a heater support 258. In operation, the heater 109 is used to heat the auxiliary gas and droplets after they exit the needle capillary 113 in order to facilitate desolvation. The heater 109 is supported by the heater support 258 and is mounted in contact with a thermocouple 257 that is employed, in operation, for temperature measurement and control.

In operation, most of the length of the probe 204 (not shown in FIG. 2B) is disposed within the channel 254. Accordingly, the probe is aligned parallel to the channel 254. Such orientation of the probe causes the emitted spray plume to be directed away from an ion aperture which is illustrated, in FIG. 2B, as a lumen of an ion transfer tube 104. The ions that are liberated from the spray plume are drawn into the aperture by an electric field that results from an electrical potential difference between the tip of the needle capillary 113 and a counter electrode (e.g, the ion transfer tube 104). At the same time, the physical flow path of neutral gas molecules and residual droplets causes the majority of these unwanted particles to be directed away from the aperture.

Figure 2D:
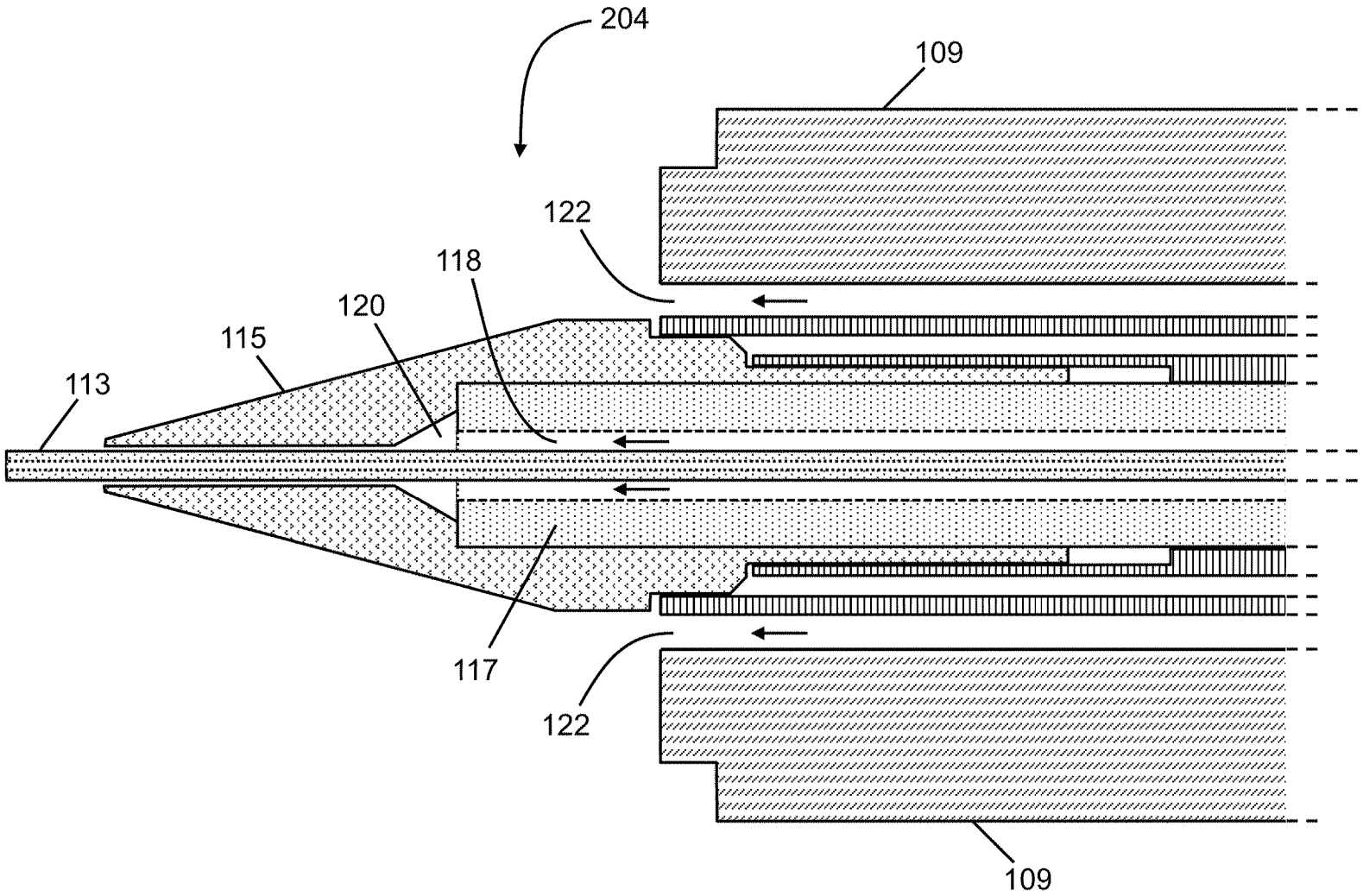
FIG. 2D (Prior Art)
FIG. 2D is an enlarged schematic cross-section diagram of the spray end of the ion source probe assembly of FIG. 2A.

FIG. 2D is an enlarged cross sectional view of the sprayer tip region of the probe 204. For reference, a portion of the heater 109, which is a component of the housing 250, is also depicted in FIG. 2D. In operation, the probe tip projects into the interior 262 of the ionization chamber 261 with the remaining length of the probe 204 being disposed within the channel 254 (see FIG. 2B). A spray of charged droplets of a liquid sample is introduced into the spray chamber interior 262 from the end of needle capillary 113. In this process, a continuous stream of liquid sample is provided through the lumen of the needle capillary 113. The spray plume of charged droplets is formed at the end of the needle capillary 113 under the action of an electrical potential difference between the needle capillary and a counter electrode (not shown), as assisted by a flow of the nebulizing gas (also known as sheath gas). After being provided to the probe 204 from the second gas inlet port 255, the nebulizing gas flows along the length of probe in the direction of the tip through channel 118 of a heat-insulating enclosure 117, such as a tube, that encloses a portion of the length of the needle capillary 113. The flow of nebulizing gas is directed, as shown by the arrows in channel 118, from the heat-insulating enclosure 117 into a channel 120 of needle support structure 115 that encloses another portion of the length of the needle capillary 113. The heat-insulating enclosure 117 may be constructed of a heat-insulating material, such as a ceramic, that partially shields the transfer of heat from the heater 109 to the needle capillary 113.

The probe 204 is supported by the mounting head 203 of the probe assembly 200. Accordingly, the probe is "free-floating" within the channel 254, which is defined by the interior edges of the one or both of the heater 109 and the heater support 258. The resulting gap between the heater 109 and the probe 204 defines one or more channels 122 (FIG. 2D) through which the auxiliary gas is caused to flow. Radiant energy generated by the heater causes heating of the auxiliary gas as it flows along the length of the one or more channels 122. After emerging from the channels, the heated auxiliary gas mixes with the spray plume that emerges from the end of the needle capillary 113. The heat provided by the heated auxiliary gas assists in evaporation of the solvent portion of the droplets so as to thereby liberate charged ions.

Figure 3:
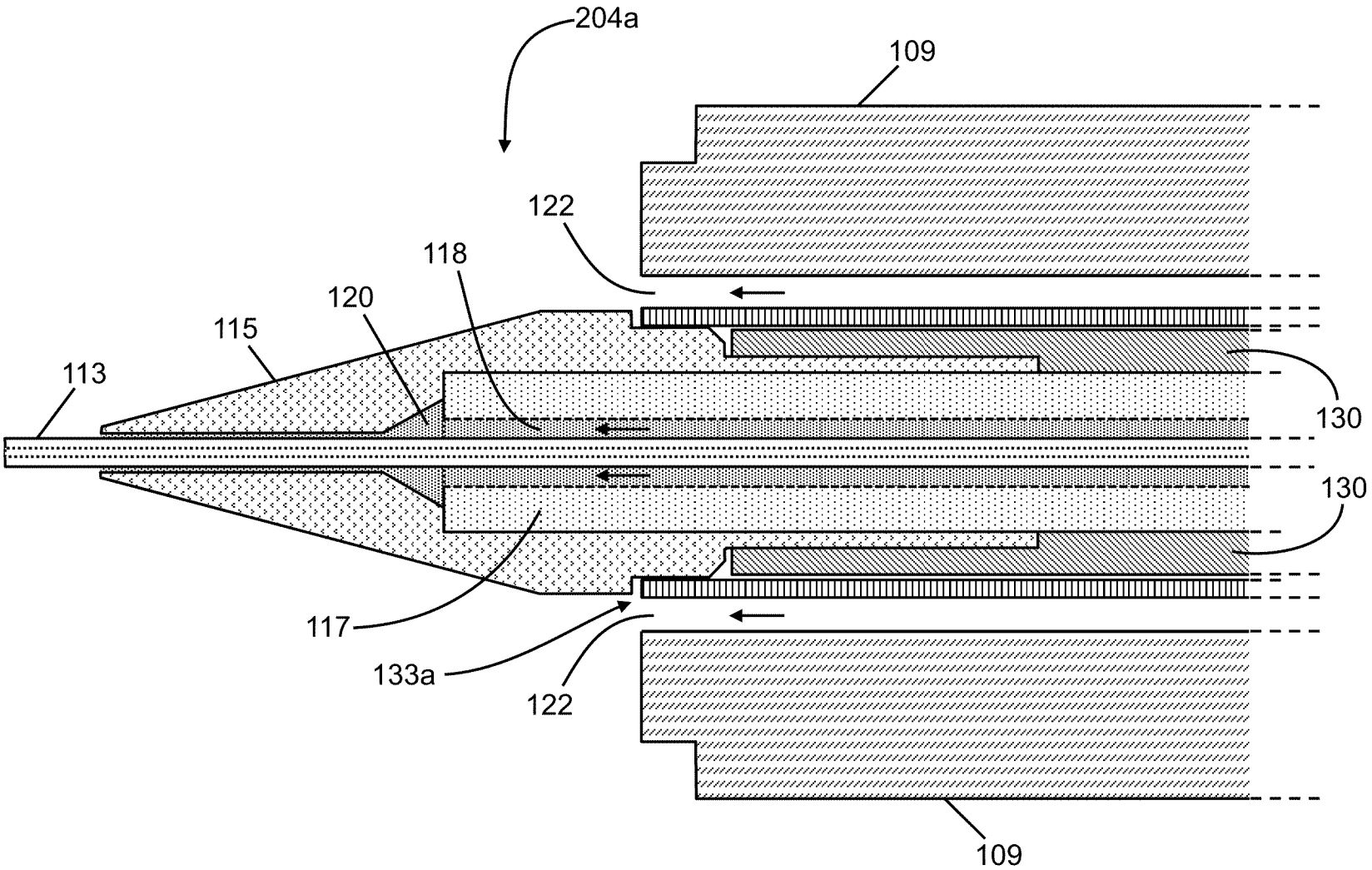
FIG. 3 is a schematic cross-section diagram of a spray end of an ion source probe assembly in accordance with the present teachings.

FIG. 3 is a schematic cross-section diagram of a spray end of an ion source probe assembly 204*a* in accordance with the present teachings. In the probe assembly 204*a*, either all or a portion of the supporting structures and/or the heat-insulating enclosure 117 are either augmented by or at least partially replaced by a heat transfer member 130. The heat transfer member 130 at least partially surrounds the needle capillary 113 along a portion of its length, thereby intercepting portion of the heat energy from the heater 109 that would otherwise, in the absence of the heat transfer member, be absorbed by the needle capillary 113. Preferably, the heat transfer member 130 completely circumferentially surrounds the needle capillary 113 along the portion of its length. For example, the heat transfer member 130 may comprise a tube or sleeve within which the portion of the length of the needle 113 capillary and the heat-insulating enclosure 117 disposed, as illustrated in FIG. 3. In other alternative embodiments, the heat transfer member 130 may be disposed within a central hollow bore of the heat-insulating enclosure 117 or may completely replace the heat-insulating enclosure 117.

In operation, the end 133*a* of the heat transfer member 130 that is closest to the spray tip end of the needle capillary is at a temperature that is close to the elevated temperature of the spray tip; the end 133*a* is therefore referred to herein as the "hot end". Preferably, the heat transfer member 130 extends along a sufficient portion of the length of the probe assembly 204*a* such that the opposite end 133*b* is at a much cooler temperature. The opposite end 133*b* is therefore referred to herein as the "cold end". Preferably, the heat transfer member 130 is formed of a material with high heat capacity and high heat conductivity that is additionally able to withstand the temperatures inside the probe 204*a* without significant degradation.

Figure 4:
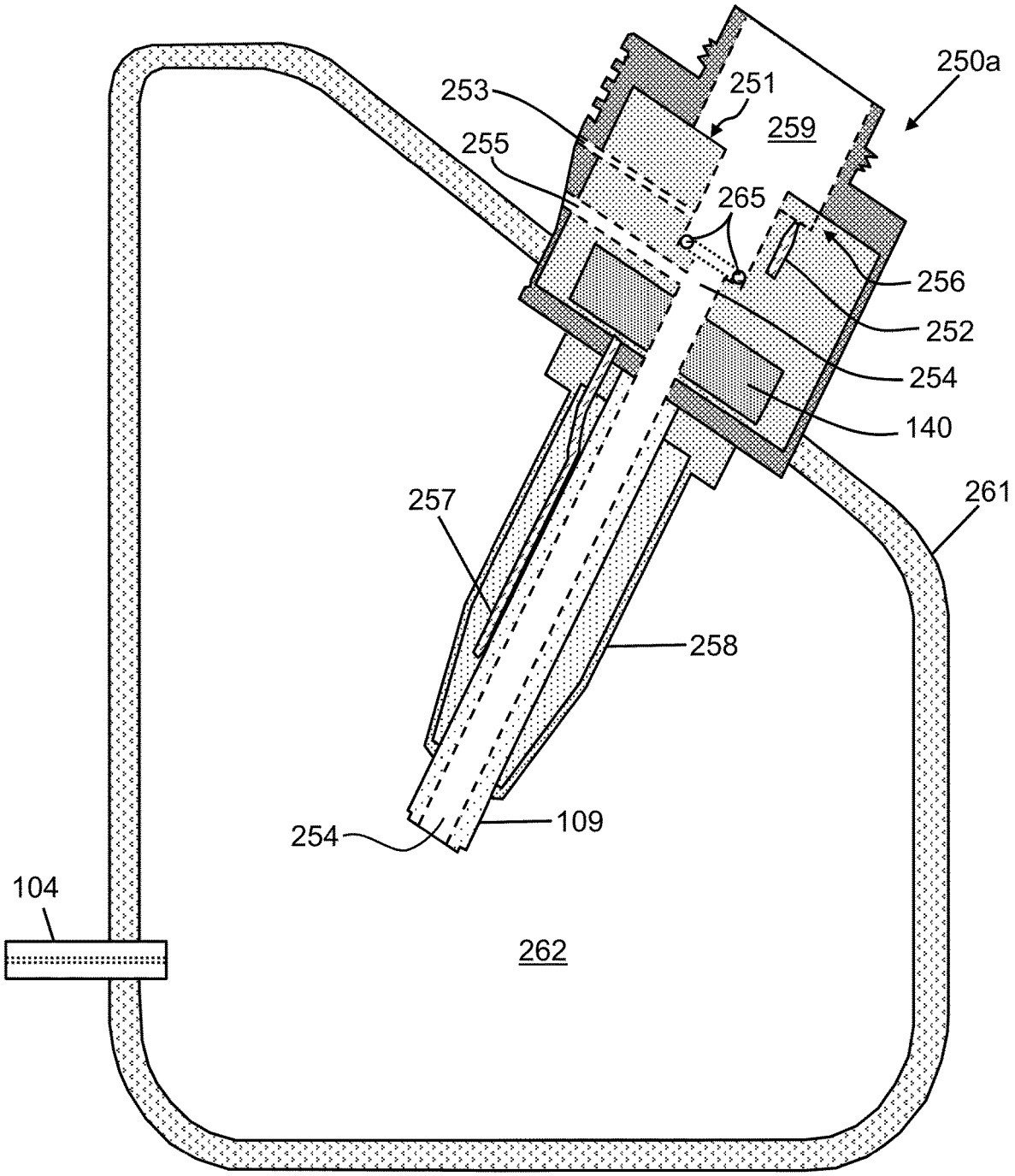
FIG. 4 is a schematic cross-section diagram of a HESI ion source housing assembly in accordance with the present teachings.

FIG. 4 is a schematic cross-section diagram of a HESI ion source housing assembly 250*a* in accordance with the present teachings. The housing assembly 250*a* is modified relative to the prior art housing assembly 250 depicted in FIG. 2B by inclusion of a heat sink member 140 in a portion of the housing assembly that is external to the ionization chamber. The heat sink member 140 is configured such that, when the probe assembly 204*a* is coupled to the housing assembly 250*a*, the cold end 133*b* of the heat transfer member is thermally coupled to the heat sink member 140. The heat sink member may comprise an active cooler such as a radiator and a fan, a Peltier cooler device, a block having an internally flowing cooling liquid, etc. Any known cooling technique may be employed. Alternatively, the heat sink member 140 may comprise a passive heat radiator without active cooling whose temperature is maintained essentially constant by immersion within a fluid bath, such as but not limited to ambient laboratory air, that may itself be assumed to be at constant temperature. Although the heat sink member 140 is illustrated as residing within a portion of the housing assembly 250*a* that is external to the ionization chamber in FIG. 4, the position of the heat sink member is not limited to this particular location. In alternative embodiments, the heat sink member may be disposed within a portion of the housing assembly that is within the interior 262 of the ionization chamber 261. In other alternatives, the heat sink member may be disposed within a portion of the probe 204*a*, in a location within the probe that is spaced away from the heater 109.

Figure 5A:
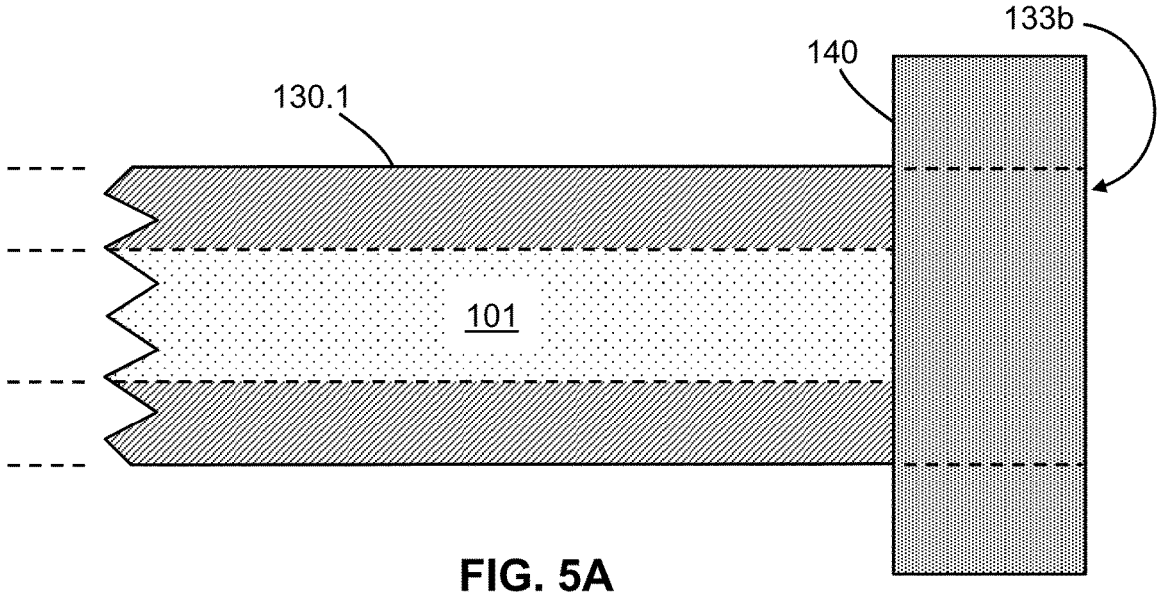
FIG. 5A is a schematic cross-section diagram of a first heat transfer member for a HESI ion source in accordance with the present teachings, the device thermally coupled to a heat sink member in accordance with the present teachings.
Figure 5B:
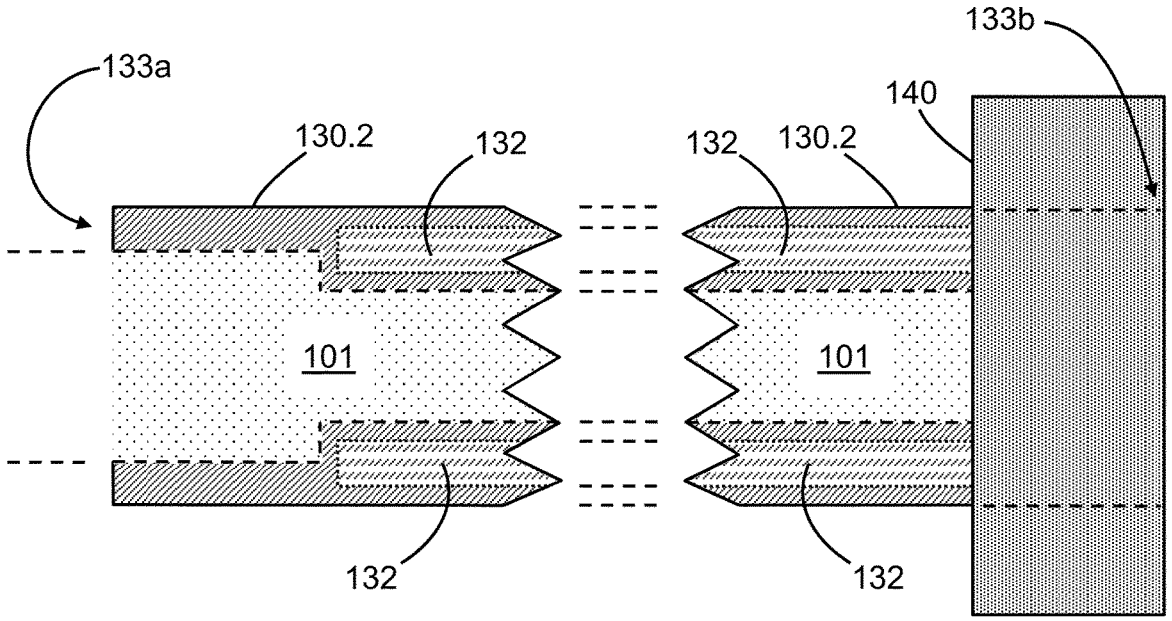
FIG. 5B is a schematic cross-section diagram of a second heat transfer member for a HESI ion source in accordance with the present teachings, the device thermally coupled to a heat sink member in accordance with the present teachings.

FIG. 5A and FIG. 5B are schematic cross-section diagrams of a first embodiment of a heat transfer member 130.1 and a second, alternative embodiment of a heat transfer member 130.2 in accordance with the present teachings, respectively, for a HESI ion source. Each heat transfer member 130.1, 130.2 is thermally coupled to a heat sink member 140 and either may be employed as the heat transfer member 130 illustrated in FIG. 3 and FIG. 6 in accordance with the present teachings. It is understood that each device 130.1, 130.2 is, in operation, disposed within channel 254 of housing 250*a* although this channel is not specifically illustrated in either of FIGS. 5A-5B. In each of FIGS. 5A-5B, an internal passageway that extends through the transfer member 130.1, 130.2 along its length is represented generally at 101. Disposed within each passageway 101 is, a portion of the length of a needle capillary including a portion of a nebulizing-gas channel and possibly other components such as a heat-insulating enclosure and structural support components. The components within the passageway 101 will generally extend beyond the ends of the heat transfer member. Each heat transfer member 130.1, 130.2 may take the form of a cylindrical tube although neither of the heat transfer members are limited to any particular form or shape.

FIG. 5A depicts only a portion of the length of the first heat transfer member 130.1 adjacent to its cold end 133*b*. FIG. 5B is a broken diagram that separately depicts lengths of the second heat transfer member 130.1 adjacent to its hot end 133*a* and its cold end 133*b*, respectively. In both instances, the heat transfer member is in close physical and thermal contact with the heat sink member 140. In FIGS. 5A-5B, a particular example of such physical and thermal contact is depicted in which a portion of the heat transfer member adjacent to the end 133*b* is embedded within a bore (indicated by dashed lines) of the heat sink member. Alternatively, the physical and thermal contact may be achieved by embedding a portion of the heat sink member 140 within a portion of the passageway 101 of the heat transfer member 130.1, 130.2. Alternatively, the heat sink member may be in physical and thermal contact with both an exterior and an interior surface of the heat transfer member. Still further alternatively, a simple configuration in which the end 133*b* of the heat transfer member 130.1, 130.2 merely abuts a surface of the heat sink member 140.

Preferably, the heat transfer member 130.1 (FIG. 5A) is formed of a material, such as a metal, with high heat capacity and high heat conductivity that is additionally able to withstand the temperatures inside the probe 204*a* without significant degradation. However, the efficiency of the heat transfer member may be improved if it is made as a thin wall closed container with a liquid medium inside serving for more efficient heat transfer, as illustrated in FIG. 5B by heat transfer member 130.2. In this example, the heat transfer member 130.2 comprises an inner chamber 132 that extends along a portion of the length of the heat transfer member and within which the liquid is disposed. For example, if the heat transfer member 130.2 is in the form of a tube, then the chamber may take the form of an annular ring or a portion of an annular ring. However, the chamber 132 is not limited to any particular form or shape. The liquid within the chamber 132 may be any liquid with high heat capacity and high boiling point to prevent pressure rise. When the sample probe is close to an upright position (which is usually the case), then the hot end 133*a* of the heat transfer member 130.2 is located at a lower elevation than the cold end 133*b*. As a result of this configuration, liquid convection inside the sink must take place, which will result in more efficient heat transfer from the bottom to the top part of the heat sink. According to various embodiments, the material within the inner chamber 132 may comprise a Lipowitz's alloy (also known as Wood's metal) or the like. This type of alloy may have a melting point as low as 70 degrees Celsius, which is less than the boiling point of acetonitrile, a common mobile phase component of solutions that may be passed through the capillary needle during mass spectral analysis of chromatograph eluates. At low to moderate temperatures (less than the melting point of the alloy) in the vicinity of the capillary needle, the heat transfer member 130.2 behaves similarly to the heat transfer member 130.1. At higher temperature that approach those at which cavitation may commence, the alloy melts and establishes convection within the melt, thereby increasing the rate of heat transfer from the hot end to the cold end of the heat transfer member.

According to some methods in accordance with the present teachings, active temperature control may be used to maintain an optimal temperature at the spray tip of the needle capillary 113 of an ion source configured as taught herein. Active temperature control may include active cooling at the cold end of the heat transfer member. The principle of operation of active temperature control is that the hot end 133*a* of the heat transfer member 130 experiences more of the heat load produced by the heater then the cold end 133*b* does. The temperature gradient between the two ends of the heat transfer member 130 results in the heat transfer from the hot end to the cold end. Active cooling of the cold end of the sink results in larger temperature difference between the hot and cold ends. By Newton's law of cooling, such active cooling leads to a higher heat transfer to the cold end. The active cooling may be accomplished, for example, by applying an electric current to a Peltier cooler of the heat sink member 140, providing a flow of a cooling fluid through the heat sink member, providing a flow of air past or through a radiator portion the heat sink member, etc. This control results in better thermal isolation of the needle capillary 113 thus preserving signal stability while maintaining a high enough auxiliary gas temperature to facilitate efficient desolvation, thus resulting in high ion signal. Moreover, at an appropriate rate of heat removal at the heat sink member 140, the method may allow for increased auxiliary gas heater temperatures and, hence, higher ion signal, while still preserving signal stability.

According to some methods of operation in accordance with the present teachings, active temperature control of the novel ion source configurations taught herein may be employed in situations in which it is desired to change the operating temperature during an analytical experiment. In such situation, the active control of the temperature of the spray tip may be accomplished by co-ordination between the rate of heat removal at the cold end 133*b* of the heat transfer member 130 and the rate of heat input at the hot end 133*a* of the device. The control of the rate of heat removal at the cold end may be accomplished as discussed in the previous paragraph. The control of the heat input to the spray tip is determined, in many cases, by controlling the amount of electrical energy applied to the heater 109 or, possibly, by controlling the flow rate of auxiliary gas.

It is anticipated that some mass spectrometry analytical methods may benefit from the change of the sample probe temperature during the method execution. One such case is when the sample that is introduced to the ion source is an eluate from a liquid chromatograph that operates with gradient elution such that solvent composition changes with time. If a chromatographic method employs a solvent (mobile phase) that becomes progressively less-enriched in a high-boiling-point component while becoming more enriched in a low-boiling-point component, then cooling of the ion-source probe is required during later stages of the method. In this case an active sample probe temperature management is necessary to preserve data quality. The active temperature management will be instrumental in accelerating the cooling of the probe (with respect to probes in prior-art ion sources) thus improving an overall mass spectrometer duty cycle.

Figure 6:
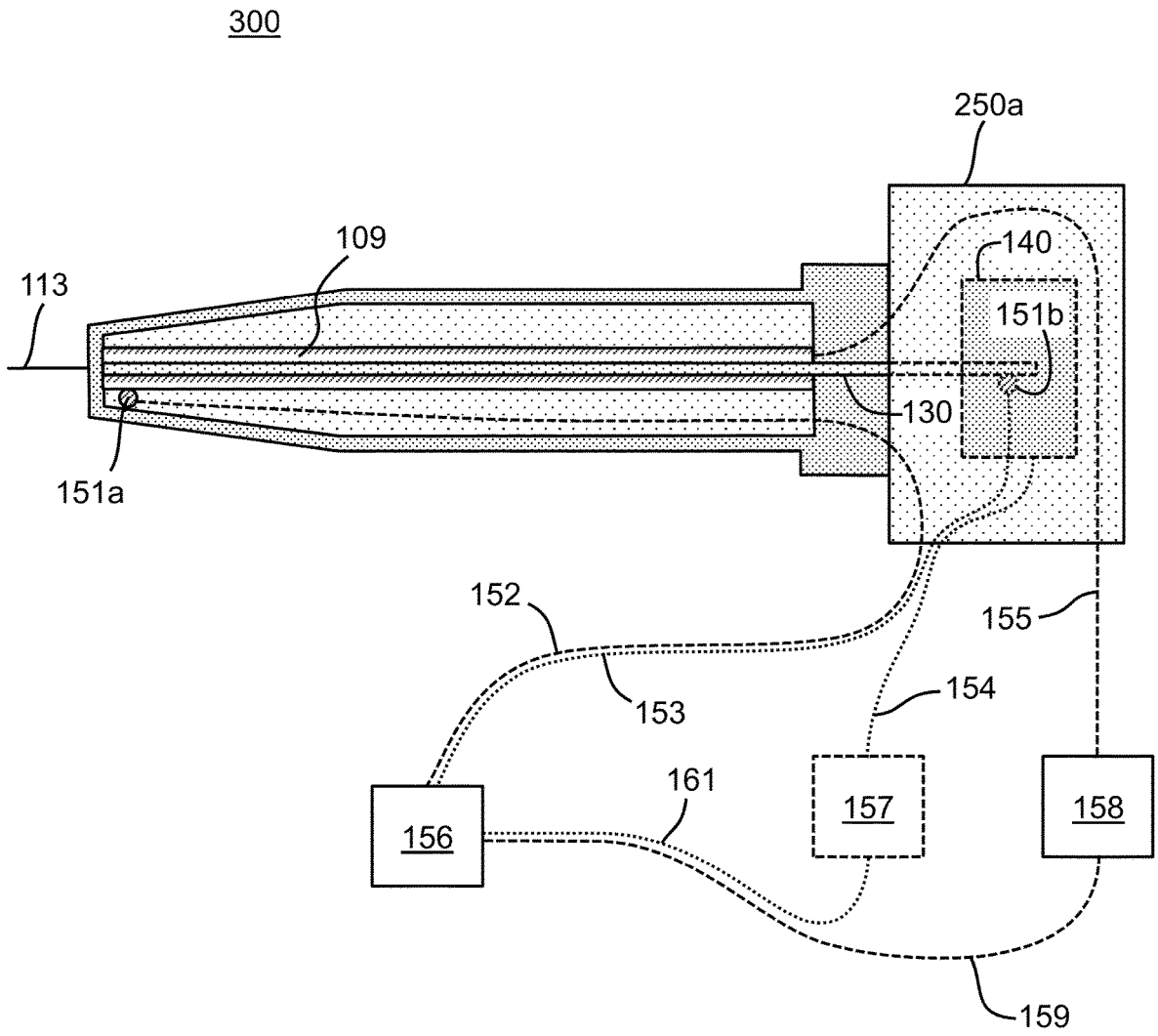
FIG. 6 is a schematic depiction of a temperature control system for a HESI ion source in accordance with the present teachings.

FIG. 6 is a schematic depiction of a temperature control system 300 for a HESI ion source in accordance with the present teachings. In FIG. 6, the temperature control system 300 is illustrated as being coupled to an ion source probe and probe housing that are configured in accordance with the present teachings. The temperature control system 300 proper comprises (or may comprise, in the case of optional components): a first temperature sensor 151*a*, disposed near the spray tip of needle capillary 113, an optional second temperature sensor 151*b*, disposed at or adjacent to the cold end of the heat transfer member 130, at least one temperature controller 156, a first electrical coupling line 152 that electrically couples the first temperature sensor 151*a* to the at least one temperature controller 156, an optional second electrical coupling line 153 that is present if the second temperature sensor is included in the system and that, under such circumstances, electrically couples the second temperature sensor 151*b* to the at least one temperature controller 156. The temperature control system 300 further comprises or may comprise: a heater power supply 158 that provides an electrical current to the heater 109 of the ion source probe, an electrical coupling line 155 that electrically couples the heater power supply 158 to the heater 109, an optional cooler control apparatus 157, an optional electrical coupling line 154 that electrically couples the cooler control apparatus 157, if present, to the heat sink member 140, an electrical coupling line 159 that electrically couples the heater power supply 158 to the at least one temperature controller 156, and an optional coupling line 161 that electrically couples the cooler control apparatus 157 to the at least one temperature controller 156.

Although the probe portion of the ion source and the elongated portion of the probe housing are illustrated as being disposed horizontally in FIG. 6, these components are not limited to this orientation or any other particular orientation. Specifically, the probe and the enclosing portions of the probe housing may be inclined, as illustrated in FIG. 4, such that the cold end of the needle capillary is at a higher elevation than the hot end. For clarity, many components of the probe assembly and housing for the probe assembly are not illustrated in FIG. 6. Nonetheless, it is understood that the probe assembly comprises a heat transfer member and heat sink member in accordance with the present teachings. The heat transfer member may be configured as schematically depicted in either FIG. 5A or FIG. 5B or may comprise some variation thereof. The electrical connections to components that are components of the probe assembly, such as the heater 109 and possibly (depending upon its location) the first temperature sensor 151*a* may be made via pin connections (not specifically illustrated) that are similar to the pin 202 (FIG. 2A) and corresponding mating electrical contact 252 (FIG. 2B) that are used to supply voltage to the needle capillary.

The electrical coupling lines 152 and, if present, 153, carry low voltage signals from the first temperature sensor 151*a* and, if present, the second temperature sensor 151*b* to the at least one temperature controller. The at least one temperature controller converts this signal (or signals) into digitized temperature information relating to the temperature of the spray tip and, if the second temperature sensor is present, the cold end of the heat transfer member. The electrical coupling lines 159 and, if present, 161 carry electronic control signals from the at least one temperature controller that control the operation of the heater power supply 158 and, if present, the cooler control apparatus 157. The temperature sensors may comprise any known type of temperature sensor, such as but not limited to thermocouples and thermistors.

The at least one temperature controller 156 may comprise a single conventional stand-alone temperature controller apparatus, a plurality of such apparatuses, a general purpose computer programmed with temperature control software or some combination thereof. The optional cooler control apparatus 157 may be chosen from a variety of forms, and may comprise a wide variety of electrical and/or physical components depending upon the exact means by which heat is removed or by which cooling is achieved at the heat sink member 140. If the means by which heat is removed is merely a passive heat radiator, then no cooler control apparatus is required. The radiator structure may include, in well-known fashion, a plurality of substantially parallel metal blades with gaps between adjacent blades. In some embodiments, the heat sink member 140 may include components that cause a flow of air or gas to be directed onto (and past) a radiator structure or other portion of the heat sink member. The flow of air may be provided by a simple electric fan, in which case the cooler control apparatus 157 may comprise a power supply and/or switch that controls the speed of the fan and/or that regulates the times when the fan is either active or inactive. Otherwise, the heat sink member 140 may include components that cause a flow of air or gas to be directed onto (and past) a radiator structure or other portion of the heat sink member, wherein the air or gas is provided from an air compressor, from a tank of compressed gas or from boiling of a cryogenic liquid, such as liquid nitrogen, that is held in a Dewar flask. In such cases, the cooler control apparatus 157 may comprise a power supply and/or switch that controls the air compressor or may comprise a valve that variably opens or closes so as to admit a greater or lesser flow rate of air or gas through the tubing. If the heat sink member 140 comprises a Peltier cooler, then the cooler control apparatus 157 may comprise a power supply that controls an amount of electrical current applied to the Peltier cooler. If the heat sink member 140 comprises a tubing or channel that removes heat by flowing a liquid through the device, then the cooler control apparatus 157 may be of a type that transmits electronic signals to one or more valves that control the flow of the liquid through the tubing or channel. The liquid may flow through a radiator structure comprising a plurality of air gaps in a honeycomb arrangement defined by a plurality of metal partitions through which the liquid flows. An electric fan may be provided to cause air to flow through the honeycomb structure. In such instances, the controller 157 may further comprise a power supply and/or electrical switch that regulates operation of the electric fan.

In various modes of operation, the temperature control system 300 may be operated so as to maintain the spray tip of the needle capillary at a constant temperature that is either below a pre-determined maximum temperature. The predetermined maximum temperature may be a temperature at which boiling or cavitation of a particular employed solvent composition is known to begin or may be a temperature at which mass spectral signal degradation due to heating is known to begin. Preferably, the temperature of a flowing auxiliary gas at an outlet end of an auxiliary gas channel is maintained, at the same time, at a temperature that assists in causing a high percentage (preferably 100%) of solvent evaporation from spray droplets emitted from the spray tip. This latter goal is generally met by causing the temperature at the outlet end of the auxiliary gas channel to be as high as possible.

When used in conjunction with a heat transfer member and heat sink member in accordance with the present teachings, the temperature control system 300 assists in achieving the goals noted above. According to a simple mode of operation, the reading of the first temperature sensor 151*a* may be monitored by the at least one temperature controller 156 and used, by the at least one temperature controller 156 to control the heater power supply 158 so as to approach but not exceed this temperature while, at the same time, heat energy is actively removed from the needle capillary by the heat transfer member and heat sink member. In this simple mode of operation, there is no second temperature sensor at the heat sink member and, thus, the heat sink member is operated in an uncontrolled fashion such as, for example, to cause a maximum amount of heat removal from the cold end of the heat transfer member.

According to a slightly more complex mode of operation, a second temperature sensor 151*b* is present at the cold end of the heat transfer member (or at the heat sink member) and the at least one temperature controller monitors the readings of both temperature sensors 151*a*, 151*b*. In this mode of operation, the at least one temperature controller 156 controls both the heater power supply 158 and the cooler control apparatus 157 based upon the readings of the two temperature sensors. As the maximum permissible temperature reading of the first temperature sensor 151*a* is approached from below, the heater power supply is ramped so as to increase the heat energy provided to the auxiliary gas by the heater while, at the same time, the output of the cooler control apparatus causes an increase the rate of heat removal from the needle capillary by the heat transfer and heat sink members. This mode of operation can enable the temperature of the auxiliary gas to be gradually changed to a higher temperature during the course of mass spectrometer operation, based on a change from a volatile solvent to a less volatile solvent in a liquid sample stream delivered to the ion source. A third mode of operation may be employed when there is a change from a less-volatile solvent to a more-volatile solvent. In such instances, the maximum permissible temperature of the spray tip is reduced as a result of the change to the more-volatile solvent. The use of controlled cooling at the heat sink member can reduce the time required to accomplish the required temperature change from a first temperature to a lower second temperature. In this mode of operation, either the power applied to the heater may be reduced, while maintaining constant cooling operation or, alternatively, the cooling may be increased by lowering the temperature of the heat sink member while maintaining constant power to the heater.

Improved ion sources for a mass spectrometer and methods of using the ion sources have been disclosed herein. The discussion included in this application is intended to serve as a basic description. The present invention is not intended to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

The invention claimed is:

1. An electrospray ion source comprising:

a needle capillary comprising a spray tip end and an opposite end;

a nebulizing gas channel parallel to the needle capillary;

a heater parallel to a length of the auxiliary gas channel;

a thermally conductive heat transfer member parallel to a length of the needle capillary and disposed between the needle capillary and the heater, said thermally conductive heat transfer member comprising:

a tube or sleeve having an inner surface defining a passageway within which the needle capillary and the nebulizing gas channel are disposed, the tube or sleeve having a first end adjacent to the spray tip end of the needle capillary, a second end opposite to the first end and an outer surface;

an internal chamber within a wall of the tube or sleeve and disposed between the outer surface and the inner surface of the tube or sleeve; and a liquid melt enclosed within the internal chamber, configured to establish, during operation, convection within the melt, thereby increasing a rate of heat transfer from the first end to the second end of the tube or sleeve;

a cooled heat sink member in direct thermal contact with the second end of the heat transfer member; and an auxiliary gas channel parallel to the needle capillary, and disposed between the heat transfer member and the heater.

2. An electrospray ion source as recited in claim 1, wherein the opposite end of the needle capillary is disposed at a higher elevation than the elevation of the spray tip end.

3. An electrospray ion source as recited in claim 1, wherein the liquid within the internal chamber comprises a Lipowitz's alloy.

4. An electrospray ion source as recited in claim 1, further comprising:

an ionization chamber; and a housing having a portion within the ionization chamber and another portion outside of the ionization chamber, wherein at least a portion of each of the needle capillary, nebulizing gas channel, auxiliary gas channel, heater and thermally conductive heat transfer member are disposed within the housing, wherein the cooled heat sink member is disposed within the portion of the housing that is outside of the ionization chamber.

5. An electrospray ion source as recited in claim 1, wherein the cooled heat sink member comprises a bladed heat radiator.

6. An electrospray ion source as recited in claim 5, further comprising a source of air or gas configured to direct a flow of the air or gas onto the bladed heat radiator.

7. An electrospray ion source as recited in claim 1, wherein the cooled heat sink member comprises an internal channel configured to receive a flow of cooling liquid therein.

8. An electrospray ion source as recited in claim 1, wherein the internal chamber is in the form of an annular ring or a portion of an annular ring.

9. A system comprising:

an electrospray ion source comprising:

a needle capillary comprising a spray tip end and an opposite end;

a nebulizing gas channel parallel to the needle capillary;

a heater parallel to a length of the auxiliary gas channel;

a thermally conductive heat transfer member parallel to a length of the needle capillary and disposed between the needle capillary and the heater, said thermally conductive heat transfer member comprising:

a tube or sleeve having an inner surface defining a passageway within which the needle capillary and the nebulizing gas channel are disposed, the tube or sleeve having a first end adjacent to the spray tip end of the needle capillary, a second end opposite to the first end and an outer surface;

an internal chamber within a wall of the tube or sleeve and disposed between the outer surface and the inner surface of the tube or sleeve; and a liquid within the internal chamber; and a liquid melt enclosed within the internal chamber, configured to establish, during operation, convection within the melt, thereby increasing a rate of heat transfer from the first end to the second end of the tube or sleeve;

a cooled heat sink member in direct thermal contact with the second end of the heat transfer member; and an auxiliary gas channel parallel to the needle capillary, and disposed between the heat transfer member and the heater;

a temperature sensor adjacent to the needle capillary; and a temperature controller electrically coupled to the temperature sensor and to the heater.

10. A system as recited in claim 9, wherein the opposite end of the needle capillary is disposed at a higher elevation than the elevation of the spray tip end.

11. A system as recited in claim 9, wherein the liquid within the internal chamber comprises a Lipowitz's alloy.

12. A system as recited in claim 9, further comprising:

cooling means coupled to the cooled heat sink member;

a second temperature sensor in thermal contact with the cooled heat sink member; and a cooler control apparatus electrically coupled to the cooling means, the second temperature sensor and the temperature controller.

13. A system as recited in claim 12, wherein the cooler control apparatus is electrically coupled to the temperature controller.

14. A system as recited in claim 9, wherein the internal chamber is in the form of an annular ring or a portion of an annular ring.

* * * * *